US006581989B2

(12) United States Patent
Markisello

(10) Patent No.: US 6,581,989 B2
(45) Date of Patent: Jun. 24, 2003

(54) SAFETY RELEASE DEVICE FOR CLOSURE LATCHES, RELEASE LATCH AND STORAGE COMPARTMENT UTILIZING SAFETY RELEASE DEVICE, AND METHOD OF INSTALLING SAFETY RELEASE DEVICE

(76) Inventor: Frank Markisello, 86-19 97th Ave., Ozone Park, NY (US) 11417

( * ) Notice: Subject to any disclaimer, the term of this patent is extended or adjusted under 35 U.S.C. 154(b) by 0 days.

(21) Appl. No.: 09/850,912

(22) Filed: May 8, 2001

(65) Prior Publication Data

US 2002/0167182 A1 Nov. 14, 2002

(51) Int. Cl.[7] ..... E05B 3/00

(52) U.S. Cl. ..... 292/336.3; 292/DIG. 43; 16/420

(58) Field of Search ..... 292/225, 235, 292/DIG. 43, 336.3; 16/420, 428

(56) References Cited

U.S. PATENT DOCUMENTS 1,488,441 A * 3/1924 Sanders
3,062,033 A * 11/1962 Schmalfeldt ..... 70/256
3,894,761 A * 7/1975 Brennan ..... 292/225
4,112,620 A * 9/1978 Sandow ..... 49/8
4,199,176 A * 4/1980 Kelly ..... 292/38
4,337,610 A * 7/1982 Taylor ..... 54/24
5,237,722 A * 8/1993 Ott ..... 16/114 B
5,445,326 A * 8/1995 Ferro ..... 292/336
6,135,514 A * 10/2000 Kowalewski ..... 292/216

* cited by examiner

*Primary Examiner*—Gary Estremsky
(74) *Attorney, Agent, or Firm*—Adams & Wilks

(57) ABSTRACT

A safety release device comprises a release handle and a flexible cable having first and second end portions each for removable connection to the release handle, and an intermediate portion disposed between the first and second end portions. The intermediate portion of the release handle is capable of engagement with a detent lever of a closure latch so that the detent lever may be released by manually pulling on the release handle.

14 Claims, 3 Drawing Sheets

SAFETY RELEASE DEVICE FOR CLOSURE LATCHES, RELEASE LATCH AND STORAGE COMPARTMENT UTILIZING SAFETY RELEASE DEVICE, AND METHOD OF INSTALLING SAFETY RELEASE DEVICE

BACKGROUND OF THE INVENTION

1. Field of the Invention

The present invention relates generally to safety release devices for releasing closure latches and, more particularly, to a safety release device for releasing the latch of a closure of a storage compartment, such as a motor vehicle trunk lid, from the inside of the storage compartment. The present invention is also directed to a release latch and storage compartment utilizing the safety release device and to a method of installing the safety release device.

2. Background Information

Motor vehicle trunks are usually secured in the closed position by a latch mechanism operable only from the exterior of the trunk lid. A rotary cylinder lock has a release arm which operatively engages a latch release of the latch mechanism. Upon turning of a key in the cylinder lock, a rotation of the release arm about its longitudinal axis is effected which trips the latch release to disengage the latch mechanism and open the trunk.

Although the prior art discloses several devices for remotely releasing the trunk latch mechanism from inside the passenger compartment, there is a lack of a simple, cost effective means for opening the trunk lid from within the trunk compartment. Thus, it has happened on occasion that children have accidentally locked themselves in automobile trunks and have been unable to get out. Even adults have found themselves locked in automobile trunks under varying circumstances. For example, there have been instances where individuals have been kidnapped and taken as hostages and, in order to transport them from one place to another without detection, they are hidden in the trunk of an automobile. In some cases, the automobile is abandoned with the individual in the trunk or the person simply left in the trunk for long periods of time, with resultant death or serious physical harm due to lack of air or exposure to cold or heat. In these cases, even if any tool were available to the individuals within the trunk compartment, the average person would lack the necessary skill to open the trunk in the dark.

There have been proposals for means whereby a person within a locked automobile trunk could release the latch from inside and without use of a key. An example of one such proposal is in U.S. Pat. No. 3,992,909. However, the mechanism shown in U.S. Pat. No. 3,992,909 is quite complicated and requires several manipulations including first declutching an inner member for the key lock. Furthermore, the remotely controlled latch arrangements previously referred to might conceivably be manipulated from within the trunk to release the lid but they involve rather complicated mechanisms to be installed by the manufacturer. Examples of such proposals are shown in U.S. Pat. Nos. 3,016,968, 3,062,033, 2,877,038 and 3,985,381. In each of those devices the latch mechanism itself must be modified, at the time of manufacture, to accommodate or provide for the remote control mechanism.

U.S. Pat. No. 5,445,326 discloses a release assembly that may be actuated by a person inside a trunk by pulling a flexible cable coupled to a detent lever within the latch pulled by a person to open the trunk. However, such a release assembly requires a permanent connection to the trunk lock and thus cannot be readily installed in and removed from existing trunk locks. Furthermore, such release assembly cannot be deactivated temporarily at times when interior lock access is not wanted.

SUMMARY OF THE INVENTION

It is an object of the present invention to provide a safety release device for releasing the latch of a closure of a storage compartment from the inside of the storage compartment.

Another object of the present invention to provide a safety release device for vehicle body closure latches, such as an automobile trunk lock, which permits the opening thereof from within the vehicle body as well as by use of conventional key means from outside the vehicle body.

Another object of the present invention is to provide a safety release device for vehicle body closure latches which may be economically produced and applied to new vehicles, or which permits ready conversion of the closure latches of existing vehicles.

A further object of the present invention is to provide a safety release device which can be readily connected to a vehicle body closure latch and which, by visual inspection by someone within the vehicle body, would immediately indicate the purpose and manner of actuation of the safety release device to actuate the release of the vehicle body closure latch.

Another object of the present invention is to provide an improved safety release device for a trunk compartment that facilitates quick and easy self-extrication of a person trapped in the trunk compartment.

Another object of the present invention is to provide a safety release device for vehicle body closure latches that is easy to activate and does not require significant manual dexterity or strength to activate.

It is still another object of the present invention to provide a safety release device for a vehicle trunk lid that can be easily activated by someone who does not have knowledge of its existence prior to entering the trunk compartment.

Another object of the present invention is to provide a safety release device for vehicle body closure latch that can be selectively connected to and disconnected from the latch.

Another object of the present invention is to provide safety release device that may be installed as a retrofit kit on existing vehicles or as original equipment on new vehicles.

Another object of the present invention is to provide a safety release device for the locking mechanism of automobile trunk lids that can readily be operated in the dark by a person trapped within the trunk compartment.

Another object of the present invention is to provide a safety release device for a trunk compartment lid which includes a release handle having a luminescent coating so that the release handle is readily visible by a person located inside the trunk compartment.

Another object of the present invention is to provide a safety release device for trunk lids which can be operated manually by one hand from inside the trunk compartment and which can be located and identified by touch alone.

A further object of the present invention is to provide an extremely simple, safe and reliable safety release device operable from inside a trunk compartment to permit opening of the trunk lid to gain access from the compartment interior.

Another object of the invention is to provide a safety release device by which persons locked within a trunk compartment can readily extricate themselves by simply pulling a ring located inside the trunk lid adjacent to the trunk locking mechanism.

A still further object of the present invention is to provide a safety release device that adequately performs its function when installed in trunk compartments of a wide variety of motor vehicles; yet is of compact construction with a minimum number of parts.

Another object of the present invention is to provide a safety release device for vehicle body closure latches which is of a durable and reliable construction.

A further object of the present invention is to provide a release latch utilizing the safety release device of the present invention.

A further object of the present invention is to provide a storage compartment utilizing the safety release device of the present invention.

A still further object of the present invention is to provide a method of installing the safety release device of the present invention.

In addition to the numerous advantages apparent from the foregoing discussion, the present invention has the further advantages of simplicity, ruggedness, durability, and ease and economy of construction and installation. The novel safety release device can be constructed from standard parts, all of which are commercially available, and can be manufactured and assembled and installed with relatively few and inexpensive tools.

The foregoing and other objects of the present invention are carried out by a safety release device comprising a release handle, and a flexible cable having first and second end portions for connection to the release handle and an intermediate portion disposed between the first and second end portions for operative engagement with a detent lever of a latch of a vehicle body closure so that the detent lever may be released by pulling on the release handle.

In another aspect, the present invention is directed to a release latch having a housing having an aperture therethrough, a latching lever pivotally mounted to the housing for receiving and capturing a catch, and a detent lever pivotally mounted to the housing for releasably securing the latching lever upon reception of the catch by the latching lever. A release handle is disposed exteriorly of the housing. A cable has first and second end portions connected to the release handle and an intermediate portion disposed between the first and second end portions. The intermediate portion extends through the aperture of the housing and operatively engages the detent lever so that the latching lever may be pivoted to release a captured catch by pulling the release handle to release the detent lever.

In another aspect, the present invention is directed to storage compartment comprising a body defining an interior space, a closure for closing the interior space, a catch connected to the body, and a release latch connected to the closure for releasing the catch. The release latch has a housing having an aperture therethrough. A latching lever is pivotally mounted to the housing for receiving and capturing the catch. A detent lever is pivotally mounted to the housing for releasably securing the latching lever upon reception of the catch by the latching lever. A release handle is disposed exteriorly of the housing. A cable has first and second end portions connected to the release handle and an intermediate portion disposed between the first and second end portions. The intermediate portion of the cable extends through the aperture of the housing and operatively engages the detent lever so that the latching lever may be pivoted to release a captured catch by pulling the release handle to release the detent lever. Thus the latching lever captures the catch when the closure closes the interior space of the body. The catch is released from the latching lever from within the interior space of the body by pulling the release handle to release the detent lever In another aspect, the present invention is directed to a method of installing a safety release device to a latch assembly for releasing a detent lever of the latch assembly from the exterior of a housing in which the detent lever is disposed. The method comprises the steps of providing a safety release device having a release handle and a cable having a first end portion, a second end portion and an intermediate portion disposed between the first and second end portion, inserting the first end portion of the cable into the housing through an aperture thereof, engaging the intermediate portion of the cable with the detent lever, removing the first end portion of the cable out of the housing through the aperture thereof, and connecting the first and second end portions of the cable to the release handle so that the detent lever is released from the exterior of the housing by pulling the release handle.

BRIEF DESCRIPTION OF THE DRAWINGS

The foregoing summary, as well as the following detailed description of a preferred embodiment of the invention, will be better understood when read in conjunction with the accompanying drawings. For the purpose of illustrating the invention, there is shown in the drawings an embodiment which is presently preferred. It should be understood, however, that the invention is not limited to the precise arrangement and instrumentalities shown. In the drawings.

DETAILED DESCRIPTION OF THE PREFERRED EMBODIMENT

Figure 1:
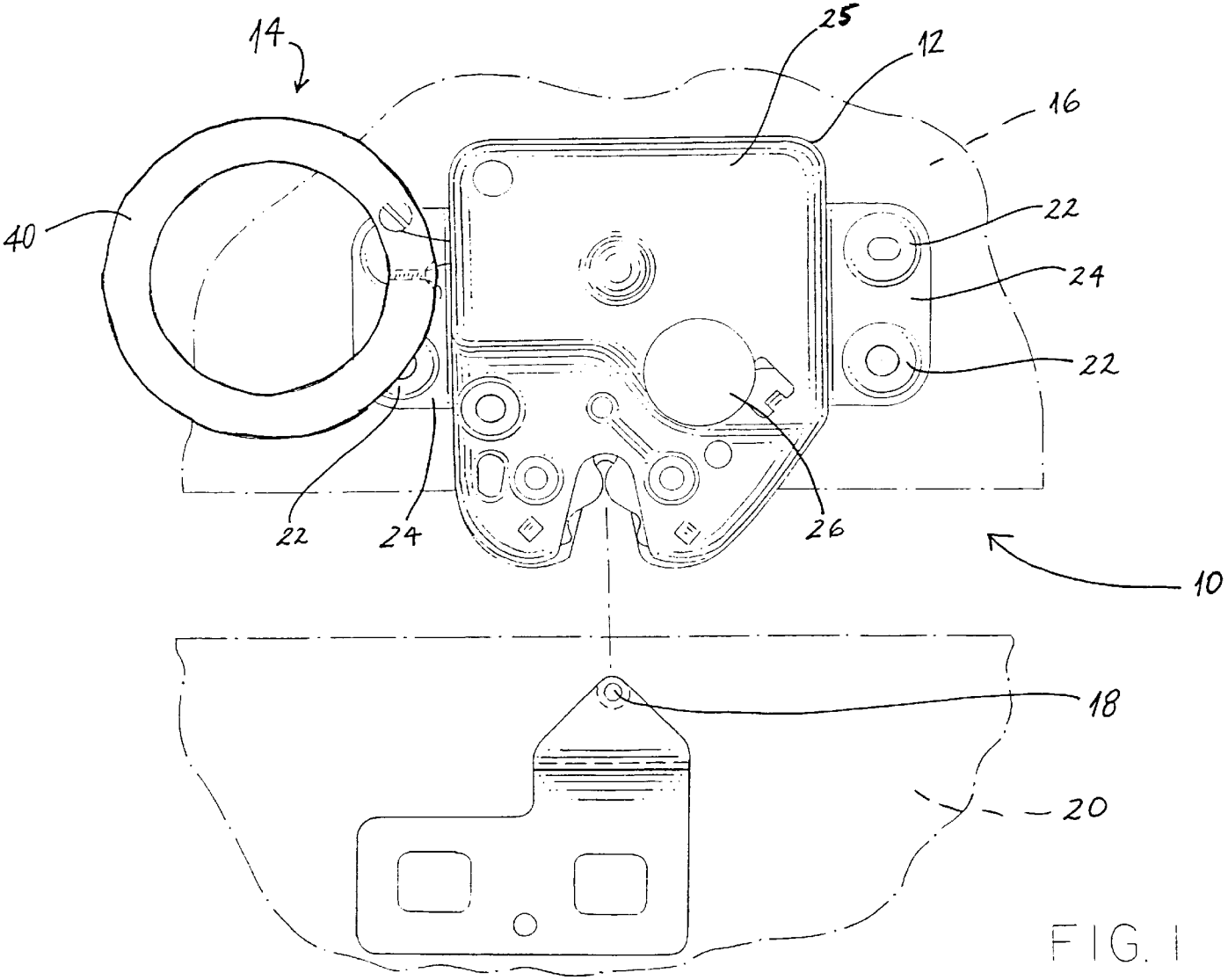
FIG. 1 is a front elevational view of a release latch utilizing a safety release device according to the present invention.

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Referring now to the drawings and particularly to FIGS. 1, 2A–2C and 3, one form of the release latch according to the present invention, generally designated at 10, comprises a latch assembly 12 and a safety release device, generally designated at 14, and is shown installed on a trunk lid 16 of a vehicle trunk compartment. A catch 18 is mounted to a vehicle body 20 in a position such that closing of the trunk lid 16 will engage the latch assembly 12 to the catch 18. The trunk lid 16 in this illustration is, for example, at the rear of the vehicle. It is to be understood, however, that the invention may be employed in conjunction with any deck lid or closure for vehicle trunk compartments regardless of the location of the compartment on the vehicle. Moreover, while the preferred embodiment of the safety release device, the release latch utilizing the safety release device, and the method of installing the safety release device according to the present invention is described below with a specific application to vehicle trunk compartments, it will be appreciated by those of ordinary skill in the art that the present invention is also well adapted for other types of storage compartments, whether on automobiles or other types of vehicles, such as trucks or watercraft, or in stationary structures such as houses and buildings.

The latch assembly 12 is illustrated as being of more or less conventional construction and may be secured to an inner panel of the trunk lid 16 by any conventional fastening means, such as by threaded bolts 22, through connecting flanges 24. A conventional key-operated cylinder lock mechanism 26 is mounted in a housing 25. An outer end of the cylinder lock mechanism 26 includes a keyhole (not shown) for receiving a key which actuates the lock mechanism 26 in the usual fashion to open the trunk lid 16 from the exterior of the trunk compartment for access therein. Such lock mechanism is basically conventional and needs no further description.

Figure 2A:
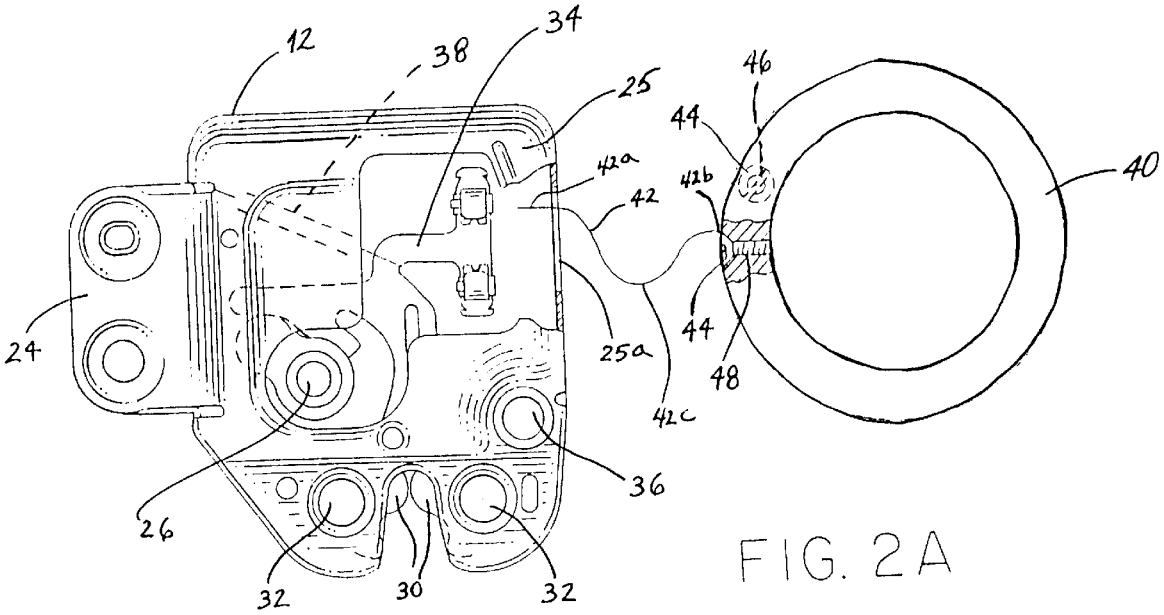
FIGS. 2(A)–2(C) illustrate a method of installing the safety release device according to the present invention.
Figure 2B:
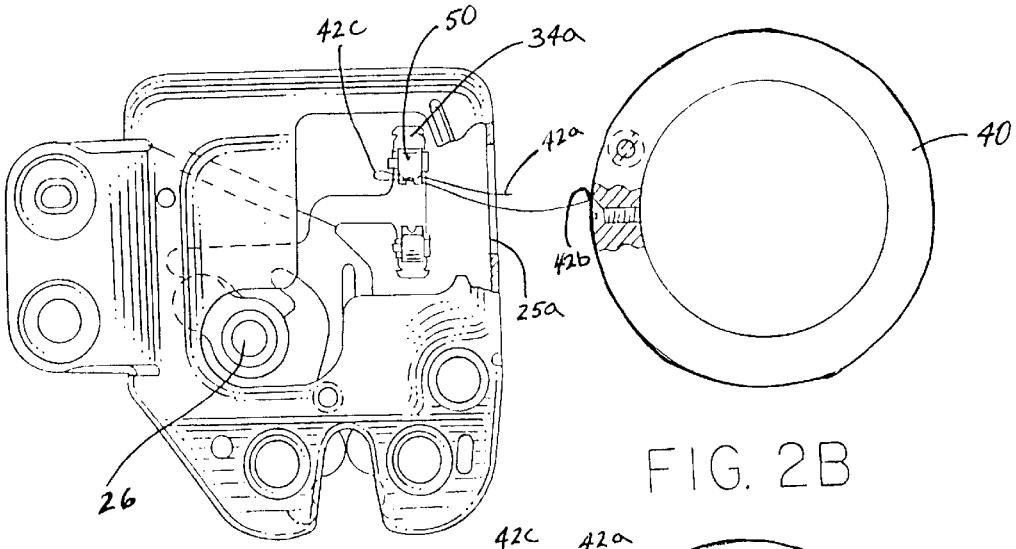
Figure 2C:
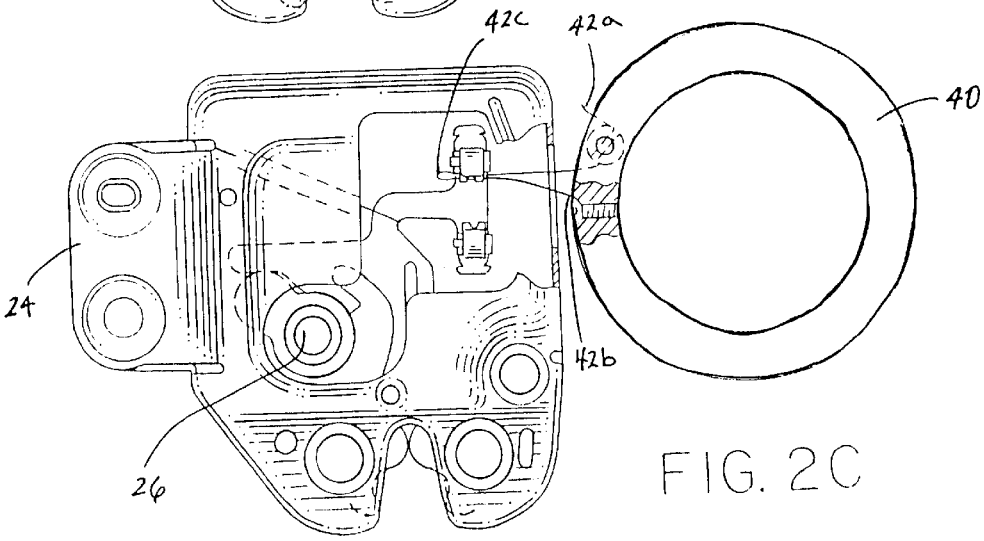

Referring to FIGS. 2A–2C, the latch assembly 12 has a pair of latching levers 30 connected together by a spring element (not shown) and pivotally mounted on pins 32 in the housing 25 for engagement with the catch 18 (hereinafter referred to as "the engagement position"). The latching levers 30 are held in the engagement position by a detent lever 34 also pivotally mounted at 36 in the housing 25. More specifically, upon capturing the catch 18, the latching levers 30 pivot into engagement with the detent lever 34 and the latch assembly 12 becomes securely coupled to the catch 18. The latch assembly 12 may be released from the catch 18 by pivoting the detent lever 34 in a first direction (i.e., in a clockwise direction as shown in FIGS. 2A–2C) to allow the latching levers 30 to release the catch 18. The detent lever 18 is biased in a second direction (i.e., in a counterclockwise direction as shown in FIGS. 2A–2C) opposite the first direction by a spring element 38. The foregoing construction of the latch assembly 12 is also conventional and needs no further description.

By the foregoing construction, the latch assembly 12 may be released from the catch 18 by the lock mechanism 26 from the exterior of the trunk compartment. Additionally, according to the present invention, the latch assembly 12 may be released from the catch 18 by a person located inside the trunk compartment through actuation of the safety release device 14, as further described below.

The safety release device 14 comprises a release handle 40 and a flexible cable 42 for connecting the release handle 40 to the detent lever 34 of the latch mechanism 12. The cable 42 has first and second end portions 42*a*, 42*b* for connection to the release handle 40 and a central portion 42*c* disposed between the first and second end portions 42*a*, 42*b* for releasable connection to the detent lever 34 of the latch assembly 12. The first and second end portions 42*a*, 42*b* of the cable are connected to the release handle 40 using suitable connecting means. In the illustrated embodiment, for example, the first and second end portions 42*a*, 42*b* of the cable are connected to the release handle 40 by threaded fasteners 44 each secured in a respective one of threaded bores 46, 48 formed in the release handle 40. However, it is understood by those of ordinary skill in the art that other forms of connection between the flexible cable 42 and the release handle 40 are suitable. For example, the second end portion 42*b* of the cable 42 may be integrally connected to the release handle 42 in a manner which does not permit the second end portion of the cable to be readily disconnected from the release handle, such as by welding, while the first end portion 42*a* of the cable may be connected to the release handle 40 by means of a threaded element as described above, thereby allowing the first end portion of the cable to be readily disconnected from the release handle by removal of the threaded element.

FIGS. 2A–2C show an embodiment of a method of installing the safety release device 14 to the latch assembly 12 according to the present invention. The second end 42*b* of the cable 42 is first connected to the release handle 40 via one of the threaded bolts 44 and the threaded bore 48. The first end portion 42*a* of the cable is then inserted into the housing 25 of the latch assembly 12 through an aperture 25*a* (FIG. 2A). Thereafter, the intermediate portion 42*c* of the cable 42 is connected to the detent lever 34 of the latch assembly 12 (FIG. 2B). The first end portion 42*a* of the cable is then removed from the housing 25 through the aperture 25*a* and connected to the release handle 40 via another of the threaded bolts 44 and the threaded bore 46 (FIG. 2C).

In the illustrated embodiment, the intermediate portion 42*c* of the cable 42 is connected to the detent lever 34 by threading the first end portion 42*a* of the cable around a connecting member 50 which is integrally mounted on a portion 34*a* of the detent lever 34. In an alternative embodiment, the intermediate portion 42*c* of the cable may be connected directly to the detent lever 34, such as, for example, by threading the first end portion 42*a* of the cable 42 through an opening (not shown) formed in the portion 34*a* of the detent lever.

Moreover, in an alternative embodiment of the method according to the present invention, the first end portion 42*a* of the cable 42 is first connected to the release handle 40, the second end portion 42*b* of the cable is inserted into the housing to connect the intermediate portion 42*c* of the cable to the detent lever 34, and the second end portion 42*b* is then removed from the housing 25 through the aperture 25*a* and connected to the release handle 40. In another alternative embodiment, the first end portion 42*a* or the second end portion 42*b* of the cable 42 can be connected to the release handle 40 by a manner which does not allow the first end portion 42*a* or the second end portion 42*b* to be readily disconnected from the release handle, such as by welding. The other of the first end portion 42*a* or the second end portion 42*b* of the flexible cable 42 is then inserted into the housing 25 of the latch assembly 12 as described above to connect the intermediate portion 42*c* to the detent lever 34. In yet another alternative embodiment, both of the first and second end portions 42*a*, 42*b* of the cable 42 are connected to the release handle 40 after the intermediate portion 42*c* of the cable is connected to the detent lever 34.

The foregoing methods of installing the safety release device 14 to the latch assembly 12 according to the present invention can be carried out while the latch assembly 12 is connected to the trunk lid 16 of the vehicle trunk compartment. It is understood, however, that the safety release device 14 can also be installed while the latch assembly 12 is disconnected from the trunk lid 16. The latch assembly 12 and the safety release device 14 are then installed as a unit on the trunk lid 16.

In the assembled state shown in FIG. 2C, pulling of the release handle 40 in a direction away from the housing 25 will cause a pivoting of the detent lever 34 in the clockwise direction and a subsequent release of the latching levers 30 from the catch 18. Thus, when the release latch 10 according to the present invention is installed within the interior of the trunk compartment as described above, a person located therein may release the latch assembly 12 to open the trunk lid 16 by pulling the release handle 40 to pivot the detent lever 34 away from the latching levers 30 to release the latch assembly 12 from the catch 18.

The flexible cable 42 is preferably made from any commercially available type of flexible plastic, fabric or metallic material. The release handle 40 is preferably made from any commercially available polymeric or elastomeric material. Alternatively, the release handle 40 can be made of a suitable metal, such as aluminum. Moreover, in the illustrated embodiment, the release handle 40 is generally in the form of a ring which allows it to be manually operated, such as by pulling, to release the latch assembly 12. It is understood, however, that other shapes and configurations are suitable for the release handle 40, such as square-, rectangular- or triangular-shaped configurations, so long as the shape allows manual operation of the release handle and immediately conveys to anyone within a trunk compartment with which the safety release device is used that the release handle serves as a means for opening the trunk compartment.

Figure 3:
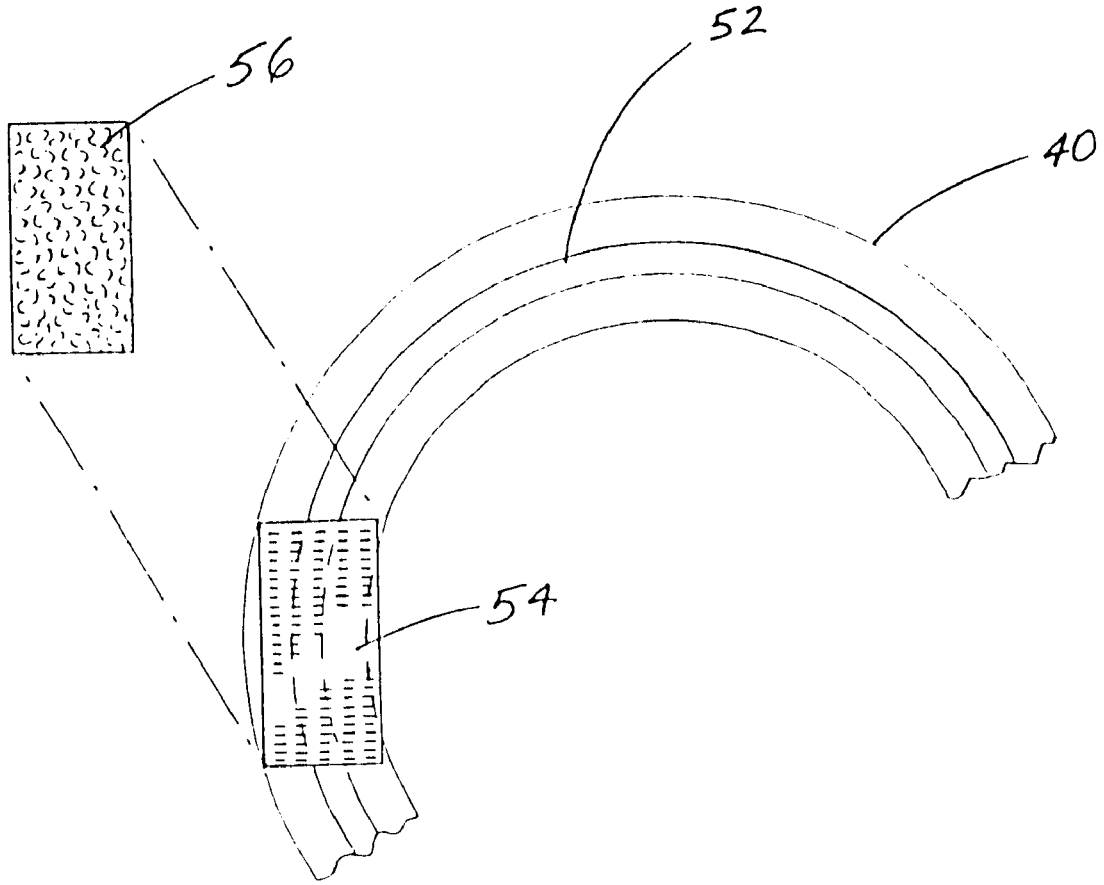
FIG. 3 is an enlarged front elevational view of a portion of the release handle of the safety release device according to the present invention showing a luminescent coating on the release handle and a connecting member for releasably connecting the release handle to a body of a storage compartment.

FIG. 3 is an enlarged front elevational view of a portion of the release handle 40. A luminescent coating 52 is preferably disposed on the release handle 40 so that the release handle is readily visible by a person contained inside the trunk compartment. The type of luminescent coating 52 which is preferred is one which will radiate sufficient light within the darkness of the trunk compartment to allow a person therewithin to locate and subsequently operate the safety release device 14 as described above.

FIG. 3 also shows a manner of releasably connecting the release handle 40 to the vehicle body 20. In the illustrated embodiment, VELCRO connectors 54, 56 are respectively attached to the release handle 40 and the vehicle body 20. After the safety release device 14 is installed on the latch assembly 12, the VELCRO connectors 54, 56 can be connected together to connect the release handle 40 to the vehicle body 20. Due to the nature of the VELCRO connection, the release handle 40 can be readily disconnected from the vehicle body 20 when it is desired to pull the release handle 40 to release the latch assembly 12. The VELCRO connection also allows sufficient movement of the release handle 40 to pivot the detent lever 34 and release the latch assembly 12 without requiring disconnection of the release handle 40 from the vehicle body 20. It is understood by those of ordinary skill in the art that releasable connecting means other than a VELCRO connection are suitable for connecting the release handle 40 to the vehicle body 20.

Thus, the present invention provides an improved release latch having a safety release device by which a trunk lid of a vehicle trunk compartment may be opened from the outside by a key engaged with a cylinder lock mechanism, or by manual manipulation (e.g., by pulling) of a release handle of the safety release device from within the vehicle trunk compartment. In use, the safety release device provides a means for a person locked within the trunk compartment to unlock and open the trunk lid. The safety release device provides a viable means of escaping from a vehicle trunk compartment in various situations, including where children who have accidentally locked themselves in vehicle trunks and have been unable to get out, where adults find themselves locked in automobile trunks under varying circumstances, and where individuals have been kidnapped and hidden in vehicle trunks.

In the foregoing cases, even if any tool were available to the individuals within the trunk compartment, the average person would lack the necessary skill to open the trunk in the dark. The safety release device according to the present invention allows it to be found easily in a dark trunk environment. It may be illuminated by any conventional means, such as by disposing a luminescent coating material on the release handle, so as to facilitate viewing of the device in the darkness of the trunk.

The safety release device according to the present invention may be installed as a retrofit kit on existing vehicles or as original equipment on new vehicles. The kit would include, for example, a release handle, a flexible cable and necessary hardware for connecting the cable to the release handle as described above with respect to the embodiments shown in FIGS. 1, 2A–2C and 3. The attachment of the kit may be readily and economically carried out with only minor modification in existing equipment.

It is understood that the relationships for the parts of the present invention, including variations in size, materials, shape, form, function and manner of operation, assembly and use, can be varied within the spirit and scope of the present invention. Furthermore, all equivalent relationships to those illustrated in the drawings and described in the specification are intended to be encompassed by the present invention.

While the release latch and safety release device of the present invention have been illustrated as by being applied to a vehicle trunk compartment, it is of course understood that these may be applied to any locking arrangement employing similar apparatus and operating in a similar manner.

From the foregoing description, it can be seen that the present invention comprises an improved safety release device, an improved release latch and an improved storage compartment utilizing the safety release device, and an improved method of installing the safety release device. It will be appreciated by those skilled in the art that obvious changes can be made to the embodiment described in the foregoing description without departing from the broad inventive concept thereof. It is understood, therefore, that this invention is not limited to the particular embodiment disclosed, but is intended to cover all obvious modifications thereof which are within the scope and the spirit of the invention as defined by the appended claims.

I claim:

1. A release latch comprising: a housing having an aperture therethrough; a latching lever pivotally mounted to the housing for receiving and capturing a catch; a detent lever pivotally mounted to the housing for releasably securing the latching lever upon reception of the catch by the latching lever; a release handle disposed exteriorly of the housing; and a cable having first and second end portions each connected directly to the release handle and an intermediate portion disposed between the first and second end portions, extending through the aperture of the housing and connected directly to the detent lever so that the latching lever may be pivoted to release a captured catch by pulling the release handle to release the detent lever.

2. A safety release device according to claim 1; wherein the release handle is generally ring-shaped.

3. A safety release device according to claim 1; wherein the release handle is comprised of a plastic material.

4. A safety release device according to claim 1; wherein the release handle has a luminescent coating.

5. A safety release device according to claim 1; further comprising at least one removable connecting member for removably connecting the first and second end portions of the cable to the release handle.

6. A storage compartment comprising: a body defining an interior space; a closure for closing the interior space; a catch connected to the body; and a release latch according to claim 1 connected to the closure so that the latching lever captures the catch when the closure closes the interior space of the body and so that the catch is released from the latching lever from within the interior space of the body by pulling the release handle to release the detent lever.

7. A safety release device according to claim 6; wherein the release handle is generally ring-shaped.

8. A safety release device according to claim 6; wherein the release handle is comprised of a plastic material.

9. A safety release device according to claim 6; wherein the release handle has a luminescent coating.

10. In combination with a release latch comprising a latch assembly having a housing, a latching lever pivotally mounted to the housing for receiving and capturing a catch, and a detent lever pivotally mounted to the housing for releasably securing the latching lever upon reception of the catch by the latching lever and for pivoting the latching lever to release the catch upon release of the detent lever, a method of installing a safety release device to the latch assembly for releasing the detent lever from the exterior of the housing, the method comprising the steps of: providing a safety release device having a release handle and a cable having a first end portion, a second end portion and an intermediate portion disposed between the first and second end portion; inserting the first end portion of the cable into the housing through an aperture thereof; engaging the intermediate portion of the cable with the detent lever; removing the first end portion of the cable out of the housing through the aperture thereof; and connecting the first and second end portions of the cable to the release handle so that the detent lever is released from the exterior of the housing by pulling the release handle.

11. A method according to claim 10; wherein the connecting step comprises connecting the second end portion of the cable to the release handle before the inserting step.

12. A method according to claim 10; wherein the engaging step comprises passing the first end portion of the cable through an opening of the detent lever.

13. A method according to claim 12; further comprising the step of forming the opening in the detent lever before the inserting step.

14. A method according to claim 10; wherein the engaging step comprises engaging the intermediate portion of the cable with a connecting element connected to the detent lever.

* * * * *